US005765606A

United States Patent [19]

Takemasa et al.

[11] Patent Number: 5,765,606

[45] Date of Patent: Jun. 16, 1998

[54] MEDICATION FILLING APPARATUS

[75] Inventors: Kazuo Takemasa; Manabu Haraguchi, both of Gunma-ken, Japan

[73] Assignee: Sanyo Electric Co., Ltd., Osaka, Japan

[21] Appl. No.: 577,820

[22] Filed: Dec. 22, 1995

[30] Foreign Application Priority Data

Dec. 28, 1994 [JP] Japan ..... 6-339322

[51] Int. Cl.[6] ..... B65B 1/04

[52] U.S. Cl. ..... 141/104; 141/247; 141/234; 221/2; 221/13; 221/252; 53/168

[58] Field of Search ..... 141/36, 94, 98, 141/100, 102, 104, 105, 107, 234, 247, 18; 222/410, 330; 121/2, 3, 9, 13, 124, 129, 133, 252; 53/154, 168

[56] References Cited

U.S. PATENT DOCUMENTS

| | | | |
|---|---|---|---|
| 3,556,342 | 1/1971 | Guarr | 221/2 |
| 3,871,156 | 3/1975 | Koenig et al. | 221/2 |
| 4,559,981 | 12/1985 | Hirano | 141/94 |
| 4,811,764 | 3/1989 | McLaughlin | 141/104 |
| 5,086,945 | 2/1992 | Corella . | |
| 5,337,919 | 8/1994 | Spaulding et al. | 221/13 |
| 5,348,061 | 9/1994 | Riley et al. | 141/104 |
| 5,481,855 | 1/1996 | Yuyama | 53/168 |
| 5,502,944 | 4/1996 | Kraft et al. | 221/2 |

FOREIGN PATENT DOCUMENTS

| | | | |
|---|---|---|---|
| 0 412 806 A1 | 2/1991 | European Pat. Off. | A61J 7/00 |
| 0 502 526 A1 | 9/1992 | European Pat. Off. | A61J 7/00 |
| 90 01 113.9 | 5/1909 | Germany | A61J 1/03 |

*Primary Examiner*—Henry J. Recla
*Assistant Examiner*—Steven O. Douglas
*Attorney, Agent, or Firm*—Darby & Darby

[57] ABSTRACT

A medication filling apparatus improves workability in filling a predetermined container with medications and also shortens the time required for medication filling. The medication filling apparatus is equipped with tablet cases for containing medications separately by type, a dispensing and counting device for dispensing the medications from the tablet cases and counting the dispensed medications, a turntable and guide for collecting the medications dispensed from the tablet cases, and a holder for filling a vial with the medications.

11 Claims, 16 Drawing Sheets

MEDICATION FILLING APPARATUS

BACKGROUND OF THE INVENTION

1. Field of the Invention

The present invention relates to a medication filling apparatus for filling a container with medications (the medications hereinafter mean tablets, capsules, pills, lozenges, and any other solid medications) specified by a prescription at a hospital or the like, or dispensed without a prescription.

2. Description of the Related Art

Conventionally, at a hospital or the like, a plurality of types of tablets prescribed by a doctor are packed by dividing them by each dose before supplying them to a patient, by using a tablet packing machine disclosed, for example, in Japanese Patent Publication No. 3-59 (A61J3/00). Such a divide and pack method, however, is basically designed to dispense tablets for each dose and collect them using a hopper, conveyor, or the like to pack them, thus requiring much time for completing the packing, including the waiting time for collecting the tablets. Moreover, the whole apparatus unavoidably becomes large because it solely depends on gravitational force to collect the tablets by using such a hopper, conveyor, or the like.

There is another type of tablet filling apparatus; it charges prescribed tablets in containers such as vials or bags for each type of tablets for a patient. This type of conventional tablet filling apparatus is designed to arrange a plurality of tablet cases, each of which is filled with a different type of tablets, like a row of lockers with the tablet cases slanted down to the front. Each tablet case is equipped with a dispensing mechanism for dispensing the tablets from the tablet case according to a prescription.

The latter type of tablet filling apparatus requires less time to complete the charging of tablets than the former tablet packing machine since it does not divide the tablets by dose; however, it requires that an operator go to the tablet case and fill a container with the tablets ejected from the dispensing mechanism. Therefore, especially when there are many types of tablets, the work for filling different types of containers with the different types of tablets becomes extremely complicated and time-consuming.

Further, the plurality of tablet cases which are disposed on a wall surface like a row of lockers prevent the reduction in the size of the whole apparatus, whereas reduced size has been required of the conventional tablet packing machine.

SUMMARY OF THE INVENTION

The present invention has been made with a view toward solving the problems with the prior art and it is an object of the present invention to provide a medication filling apparatus which is capable of improving the workability and shortening the required filling time when charging medications such as tablets in predetermined containers.

To this end, according to one aspect of the present invention, there is provided a medication filling apparatus which is equipped with: medication containing means for containing medications separately by type; dispensing and counting means for dispensing the medications from the medication containing means and counting them; and medication filling means for collecting and moving the medications, which have been ejected from the medication containing means, to a dispensing port and charging them into a predetermined container.

With this arrangement, medications are ejected from the medication containing means, which hold medications separately by type, and counted by the dispensing and counting means, then the medications which have been dispensed from the medication containing means are gathered and brought to the dispensing port by the medication filling means, so that the medications may be charged into a prescribed container through the dispensing port. Hence, a specified type of medication among a plurality of types of medications can be charged into a container at one location. This leads to markedly improved workability and quick filling and enables shortened waiting time, thus helping to provide the waiting patients with better service.

According to another aspect of the present invention, there is provided a medication filling apparatus which is equipped with: medication containing means for containing medications separately by type; dispensing and counting means for dispensing the medications from the medication containing means and counting them; and medication filling means for charging the medications, which have been dispensed from the medication containing means, into a predetermined container; wherein the medication filling means has medication collecting means which receives and collects the medications dispensed from the medication containing means and means for temporarily retaining the medications which have been gathered by the medication collecting means.

In this arrangement, the medication filling means is comprised of the medication collecting means which receives and collects the medications dispensed from the medication containing means and the means for temporarily retaining the medications which have been gathered by the medication collecting means. Therefore, when a plurality of different medications are charged in succession, for example, even if the order of the containers arranged by an operator mismatches the order of the types of medications dispensed from the medication containing means, the type of medications which have been dispensed earlier can be retained temporarily in the retaining means, so that they can be charged into a right container after the container supplied earlier has been filled. This feature helps further improve the filling workability and further shorten the total operation time especially when a plurality of different medications are charged.

According to a still another aspect of the present invention, there is provided a medication filling apparatus which is equipped with: a plurality of tablet cases for holding medications separately by type; a dispensing and counting device for dispensing the medications from the tablet case containing a specified type of medications according to predetermined dispense data and for counting the medications; a turntable which is located under the tablet cases and which rotates to receive the medications which have been dispensed the; a guide provided around the turntable; and a dispensing port which is formed in the guide.

With this arrangement, the medications are dispensed from the tablet cases, which hold the medications separately by type, and counted by the dispensing and counting device, and the medications dispensed from the tablet cases are received by the turntable rotating under the tablet cases and are gathered and moved toward the surrounding guide by the centrifugal force produced by the rotating turntable. The medications are then collected and brought to the dispensing port formed in the guide before they are finally released; therefore, the medications can be charged into a container by disposing a predetermined container at the dispensing port. Thus, a type of medication specified among a plurality of different medications can be charged in a container through the same single dispensing port. This feature also leads to markedly improved workability and quick filling and enables shortened waiting time, thereby helping to provide the waiting patients with better service.

In particular, whereas the conventional art depends solely on the gravitational force to collect medications which have been dispensed from a plurality of tablet cases, the present invention makes use of the centrifugal force of the turntable. This makes it possible to reduce the size of the medication filling apparatus especially in the vertical dimension, contributing to effective use of the space at facilities, including hospitals and pharmacies.

According to a preferred form of the present invention, the medication filling apparatus is equipped with: a plurality of tablet cases for holding medications separately by type; a dispensing and counting device for dispensing the medications from tablet cases containing a specified type of medication according to predetermined dispense data and for counting the medications; a turntable which is located under the tablet cases and which rotates to receive the medications which have been dispensed; a guide provided around the turntable; a dispensing port which is formed in the guide; a shutter for opening and closing the dispensing port; a plurality of holders for temporarily retaining the medications, which have been dispensed through the dispensing port; and covers for opening and closing the outlets of the holders.

In this arrangement, the shutter for opening and closing the dispensing port of the guide, the plurality of holders which are selectively disposed at the dispensing port and which temporarily retain the medications which have been dispensed through the dispensing port, and the covers for opening and closing the outlets of the respective holders have been added, so that when, for example, a plurality of different medications are packed in succession, even if the order of the containers arranged by the operator mismatches the order of the types of the medications dispensed from the tablet cases, the medications which have been dispensed earlier can be gathered and retained in a predetermined holder by opening/closing the dispensing port by the shutter to wait until a container supplied earlier has been filled with a medication, then the cover of the holder is opened when the right container for the retained medication is ready so that the container may be filled with the medication. Thus, the filling workability will be further improved and the total operation time will be further reduced especially when packing a plurality of different medications.

DESCRIPTION OF THE PREFERRED EMBODIMENTS

Figure 3:
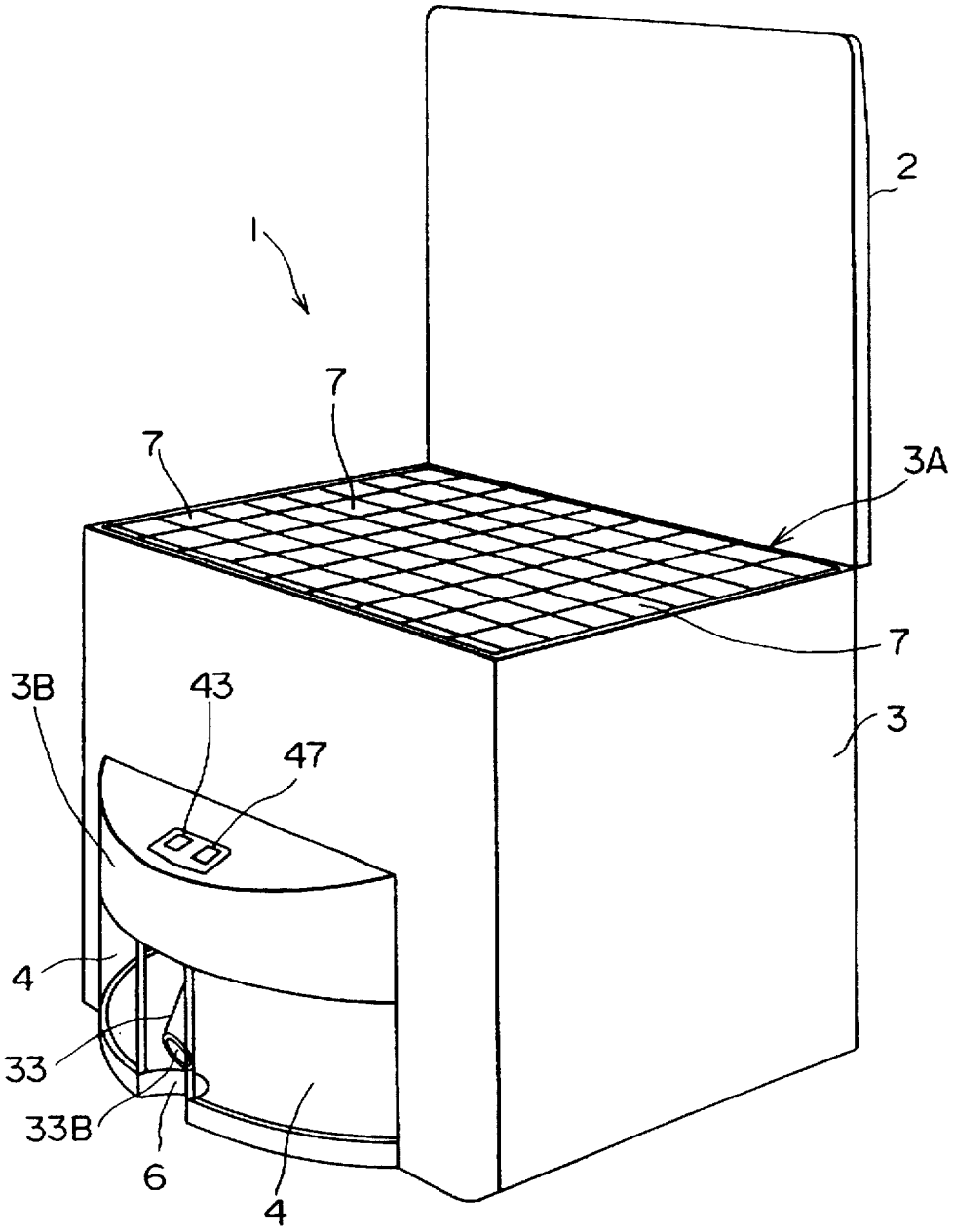
FIG. 3 is a perspective view of the medication filling apparatus in accordance with the present invention with a top table thereof opened.

The preferred embodiments of the present invention will now be described in conjunction with the accompanying drawings. A medication filling apparatus 1 according to the present invention is installed at a hospital, pharmacy, or the like. A tablet case enclosure (FIG. 3) is disposed at the top inside a rectangular outer case 3; the tablet case enclosure 3A is open upward and provided with a top table 2 which opens and closes the tablet case enclosure 3A. A filling section 3B, which has an arc-shaped cross section, is provided on the front surface of the outer case 3. Transparent glass panels 4, 4 (or acrylic panels or the like), which have arc-shaped cross sections, are installed on both sides on the front surface of the filling section 3B and an inserting opening 6 which is communicated with the filling section 3B is provided between the transparent glass panels 4, 4.

Figure 4:
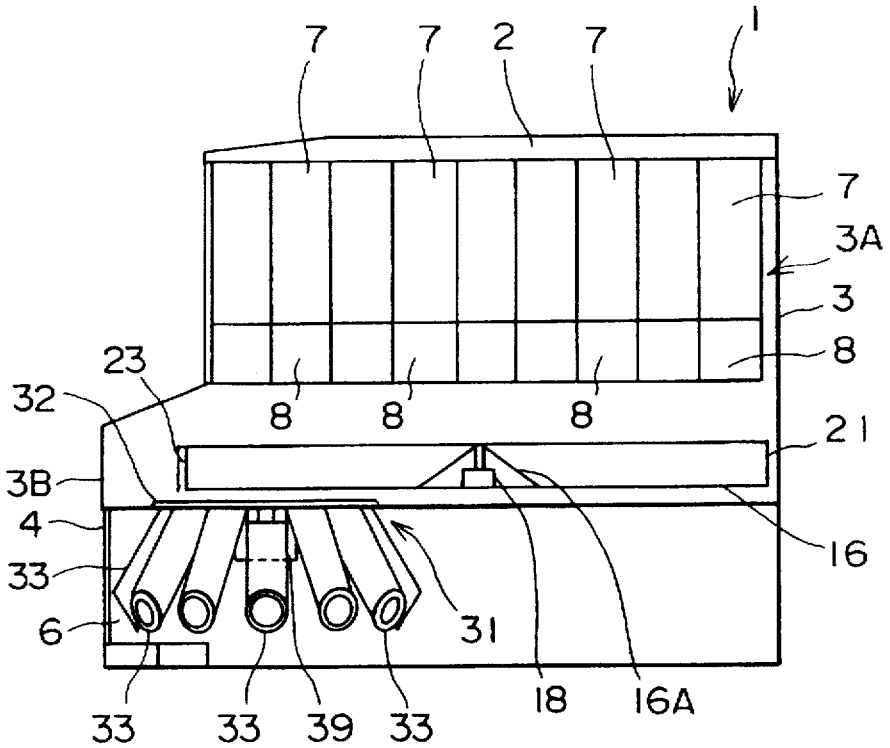
FIG. 4 is a longitudinal side view of the medication filling apparatus in accordance with the present invention.
Figure 5:
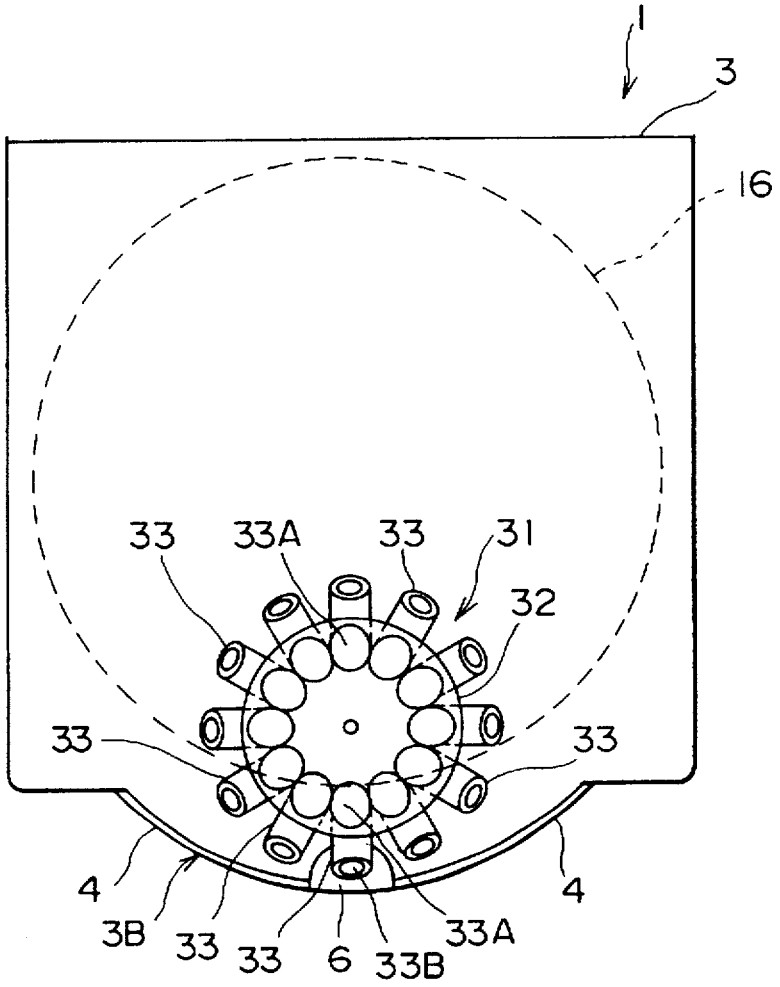
FIG. 5 is a top cross-sectional view of the medication filling apparatus in accordance with the present invention.
Figure 11:
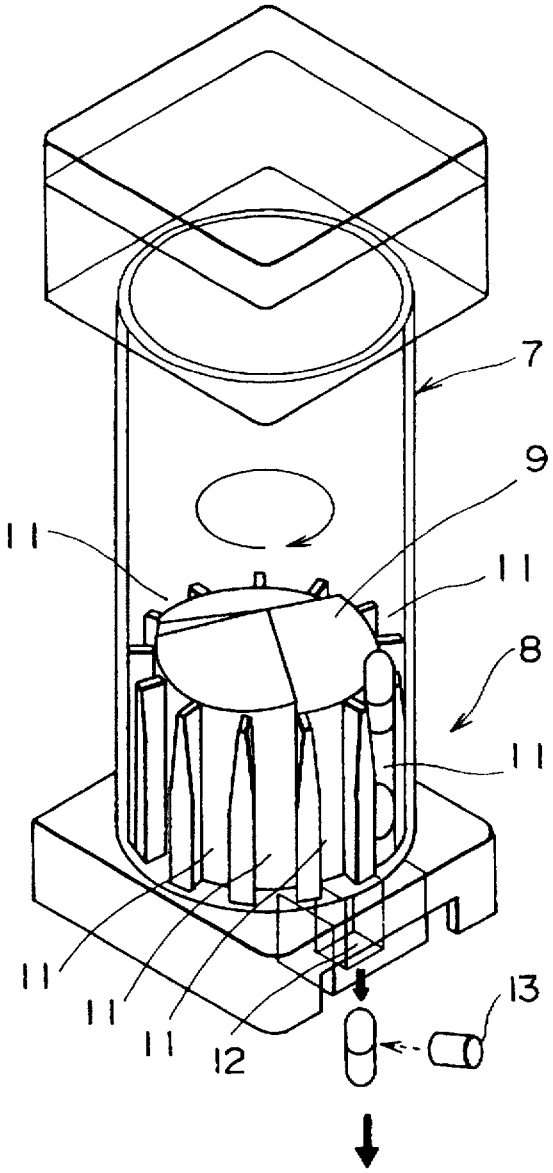
FIG. 11 is a perspective view of tablet cases and a dispensing and counting device.

A plurality of tablet cases 7 serving as the means for containing medications are disposed and housed in the tablet case enclosure 3A. The individual tablet cases 7 contain predetermined quantities of medications separately by type; dispensing and counting devices 8 (FIG. 4) serving as the dispensing and counting means are provided beneath the tablet cases 7 as shown in FIG. 11.

The dispensing and counting devices 8 are respectively communicated with the tablet cases 7 located over them, motor-driven dispensing drums 9 being incorporated therein. A plurality of vertical grooves 11 are formed on the periphery of the dispensing drum 9, so that solid medications such as tablets, capsules, pills, and lozenges (two pieces in this embodiment) are vertically aligned in each groove. As the dispensing drum 9 rotates, the medications in each groove 11 drop one by one through an outlet 12 as indicated by black arrows in FIG. 6 and FIG. 11. The dispensing and counting device 8 is further provided with a photosensor 13 for detecting the medication which has dropped out through the outlet 12.

A turntable 16 (FIG. 6) which constitutes the medication collecting means of the medication filling means is provided in the outer case 3 under the tablet cases 7 and the dispensing and counting devices 8. The turntable is shaped like a disc and has an area which is sufficiently large to encompass the bottom area of all the tablet cases 7 and the dispensing and counting devices 8. The turntable 16 has a projecting cone 16A at the center thereof; there are also provided partitioning vanes 17, 17 which extend in the radial direction from the projecting cone 16A. A turntable motor 18 drives and rotates the turntable 16 in the direction of the arrows given in the drawing at a predetermined speed.

An annular guide 21, which also constitutes the medication collecting means, is provided vertically around the turntable 16; a notch-shaped dispensing port 22 is provided at the front end of the guide 21 to communicate the turntable 16 with the area outside the guide 21. The dispensing port 22 is opened and closed by a shutter 23 which swings outward. The shutter 23 is driven by a shutter opening/closing means 24 for a solenoid plunger or the like which will be discussed hereinafter. The vertical dimension of the turntable 16 including the guide 21 is approximately 10 cm.

Provided at the bottom front of the turntable 16 and the guide 21 is a holder unit 31 which forms the temporarily retaining means of the medication filling means. As shown in FIG. 7 through FIG. 10, the holder unit 31 is equipped with a disc base 32 at the top and a plurality of holders 33 (12 holders in the embodiment) which jut out from the base 32 and slant downwards (at 60 degrees in the embodiment). The top ends of the respective holders 33 are open through inlets 33A provided in the base 32.

Figure 6:
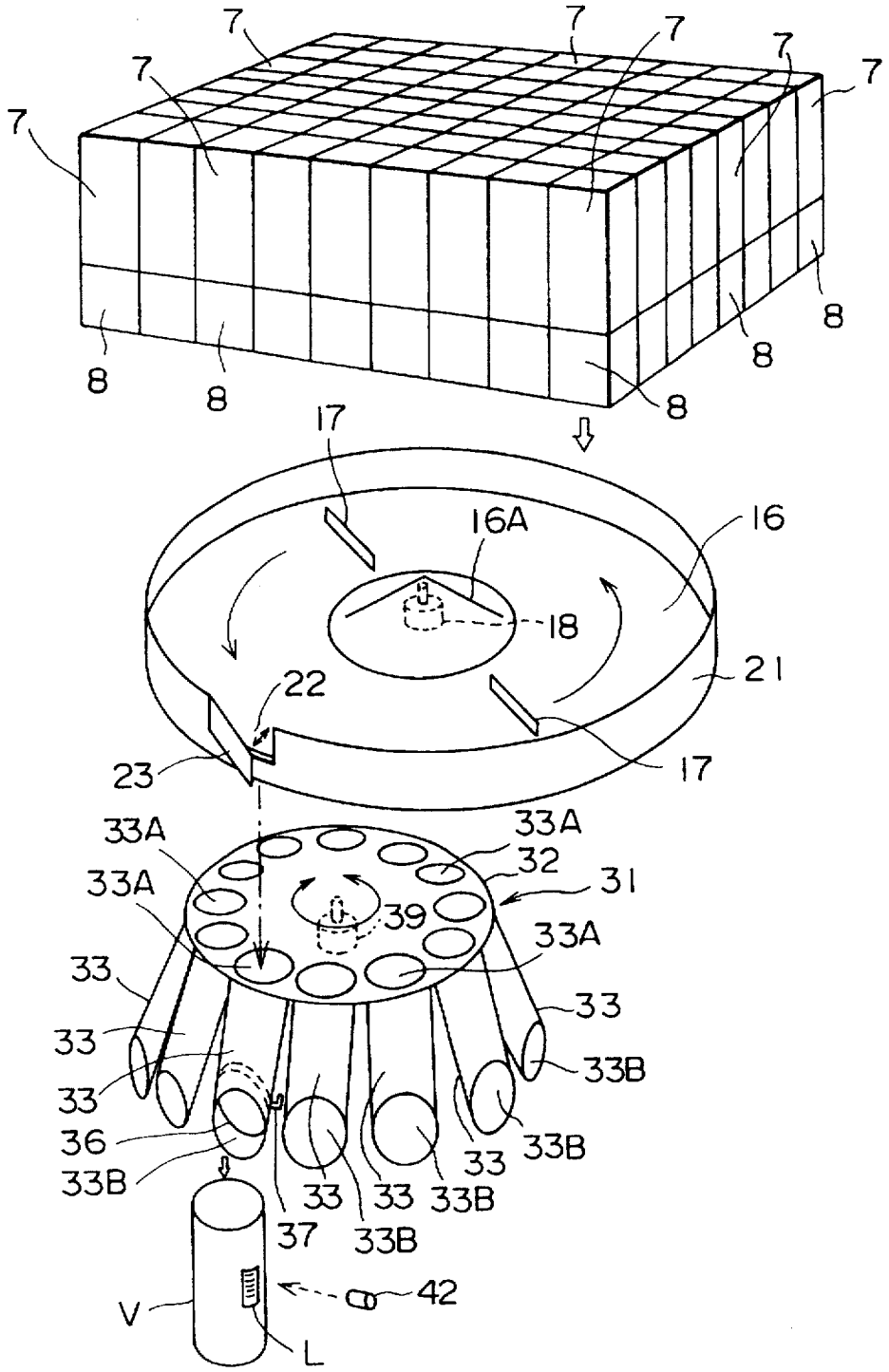
FIG. 6 is an illustration of the internal configuration of the medication filling apparatus in accordance with the present invention.
Figure 7:
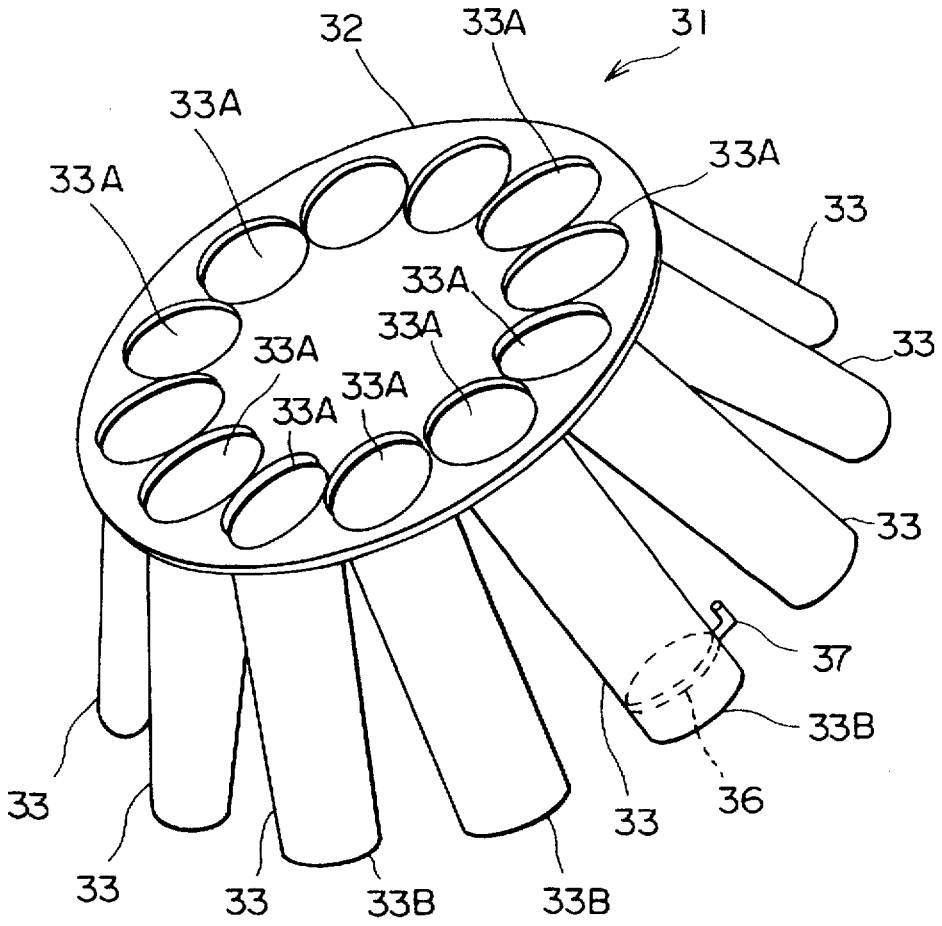
FIG. 7 is a perspective view illustrating a holder unit.
Figure 8:
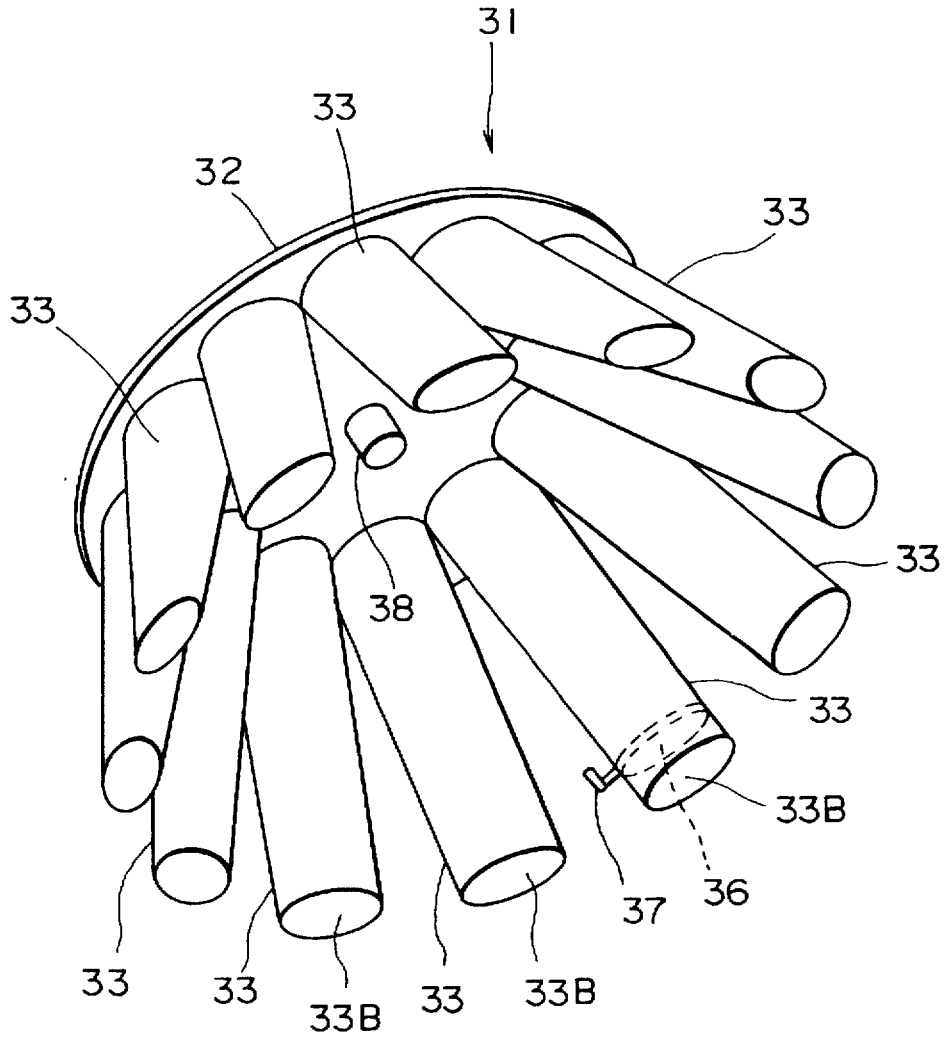
FIG. 8 is another perspective view of the holder unit.
Figure 9:
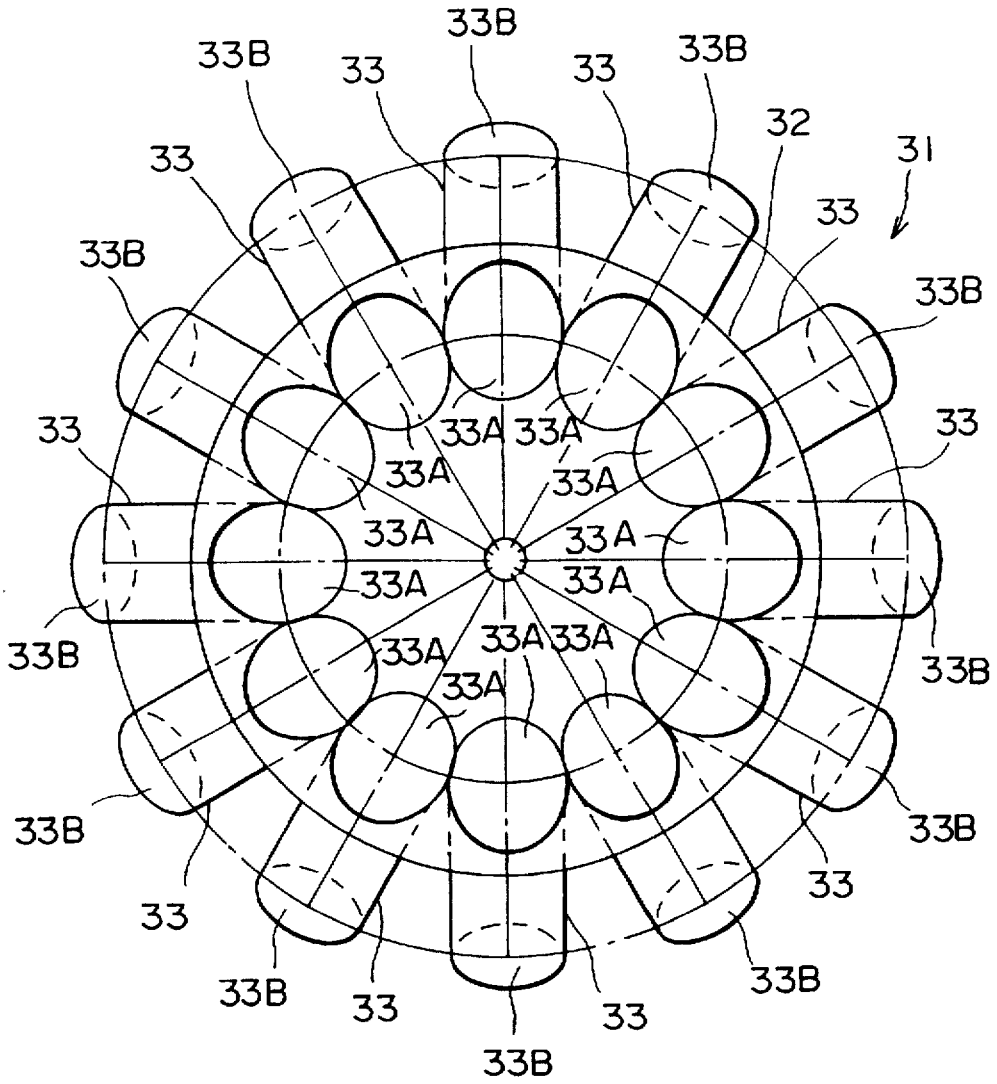
FIG. 9 is a top view of the holder unit.
Figure 10:
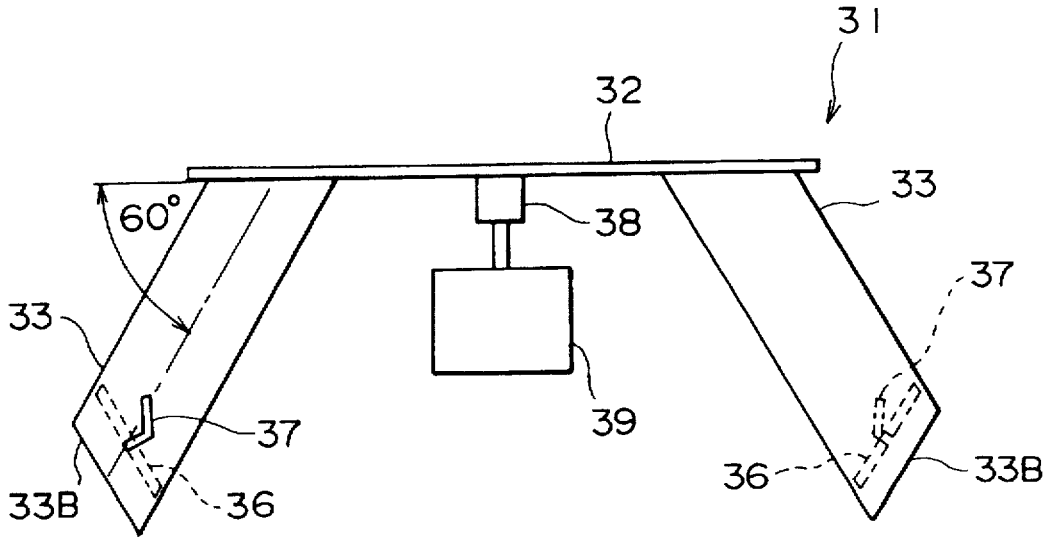
FIG. 10 is a side view of the holder unit.

Further, the respective holders 33 extend radially from the center of the base 32 as illustrated in FIG. 9; the respective inlets 33A and the outlets 33B are arranged on virtual circles which are concentric with the base 32. The respective holders 33 are provided with covers 36 for opening and closing the respective outlets 33B (only one cover is shown in FIG. 6 to FIG. 8); the covers 36 normally close the outlets 33B by springs or the like which are not shown. Each cover 36 has a handle 37 sticking out of the holder 33 and the cover 36 is swung by the handle 37 to open the outlet 33B.

A rotary shaft 38 juts out downward from the center of the base 32 of the holder unit 31. A holder motor 39 is attached to the rotary shaft 38 and the holder unit 31 is driven and rotated by the holder motor 39. The holder unit 31 is equipped with a holder position sensor 41 for detecting the positions of the respective holders 33, which will be discussed hereinafter.

Figure 1:
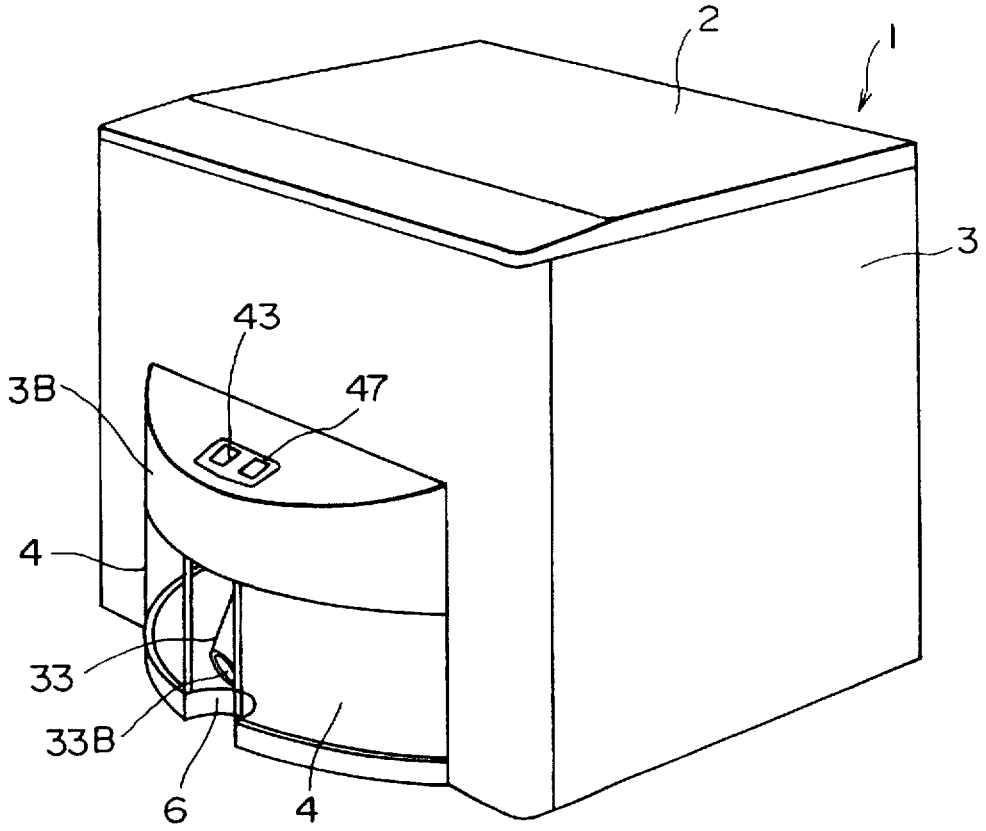
FIG. 1 is a perspective view of a medication filling apparatus in accordance with the present invention.
Figure 2:
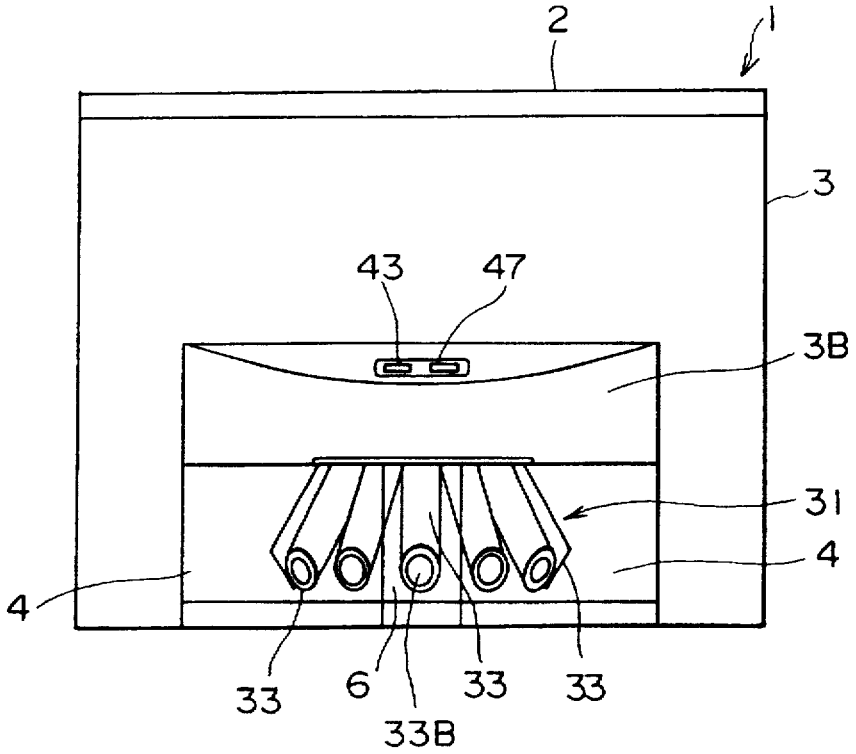
FIG. 2 is a front view of the medication filling apparatus in accordance with the present invention.

Inside the filling section 3B of the aforesaid outer case 3, there is provided a bar code reader 42 which is located near the inserting opening 6. Provided on the top surface of the filling section 3B are a key switch 43 consisting of ten keys and a display 47 for showing prescription data and preparing state and for giving an alarm (FIG. 1).

Figure 12:
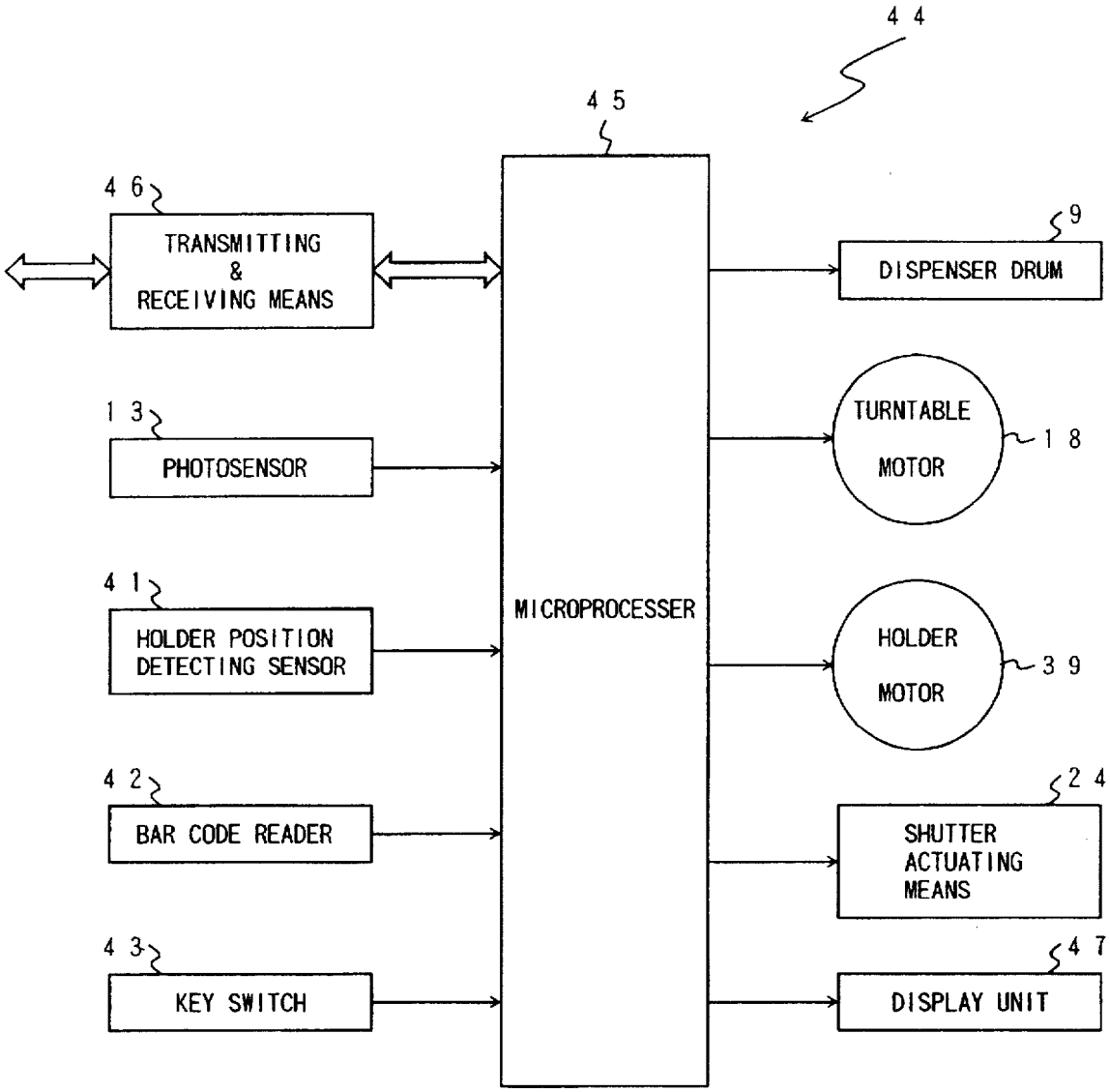
FIG. 12 is a block diagram showing a control unit of the medication filling apparatus in accordance with the present invention.
Figure 13:
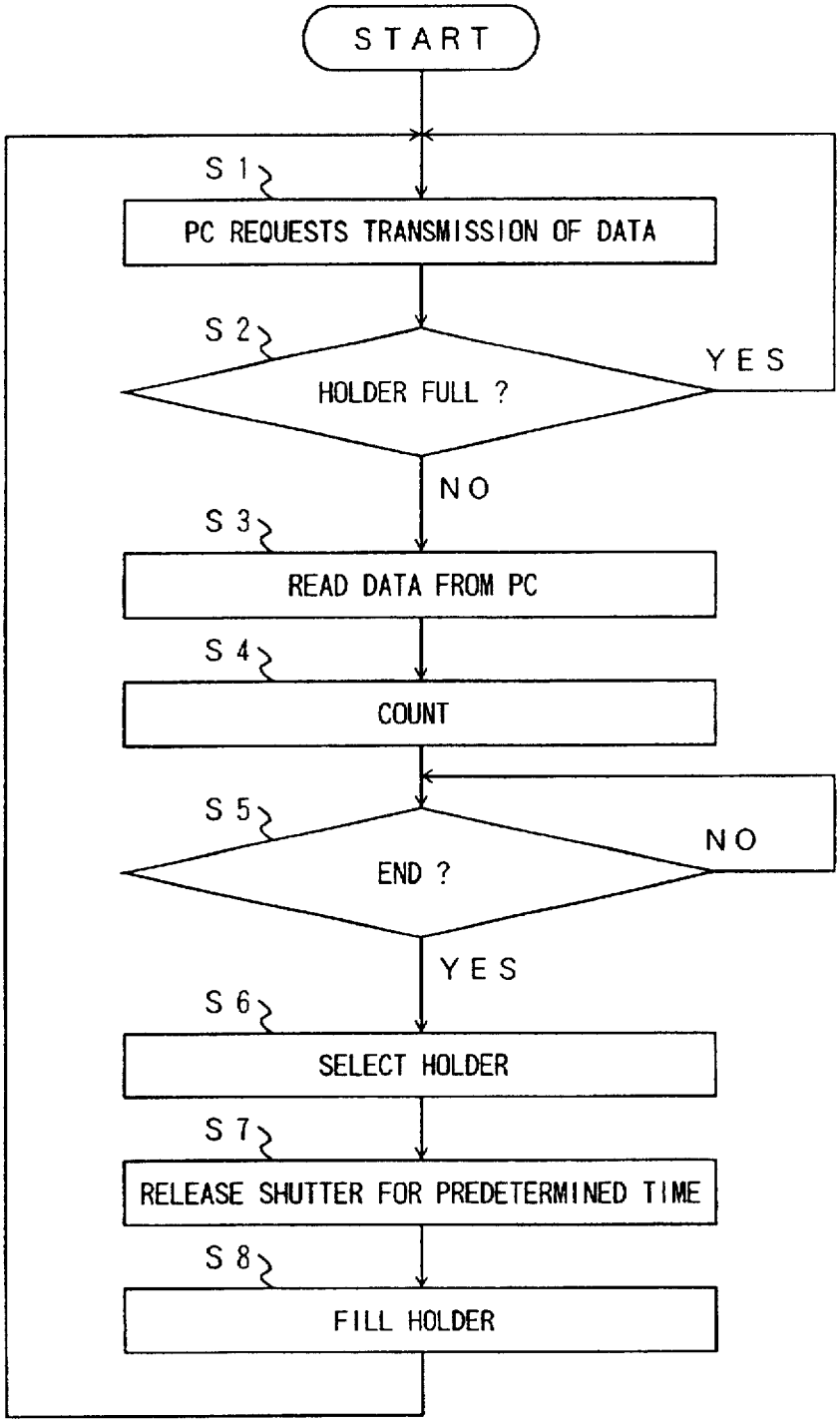
FIG. 13 is a flowchart illustrating a program of a microprocessor.
Figure 14:
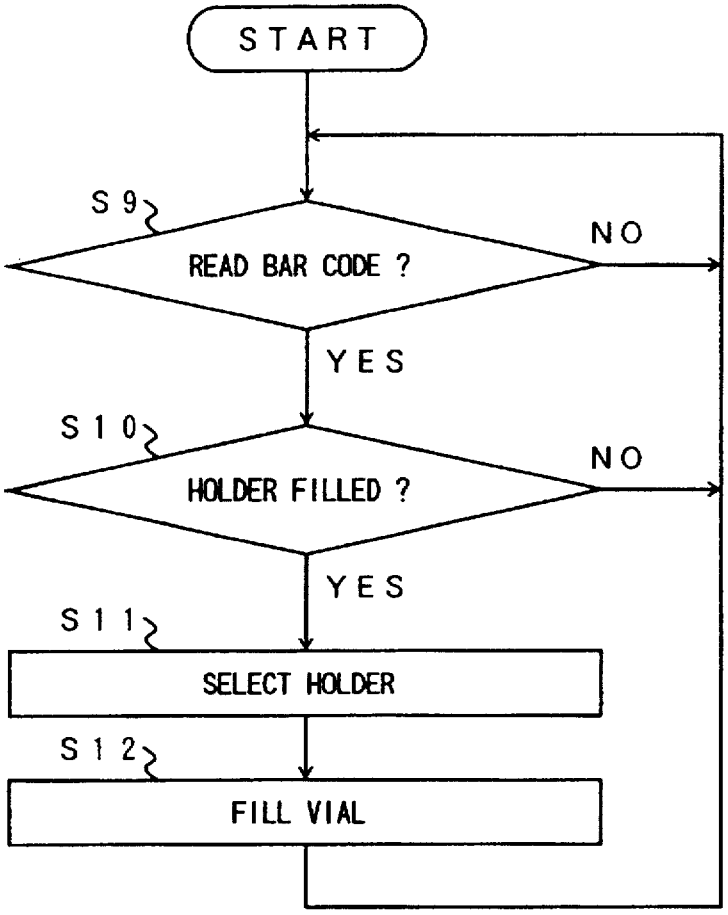
FIG. 14 is another flowchart illustrating the program of the microprocessor.

FIG. 12 is the block diagram showing a control unit 44 of the medication filling apparatus 1 in accordance with the present invention. The control unit 44 is comprised of a general-purpose microprocessor 45. Connected to the microprocessor 45 is a transmitting and receiving means 46 for exchanging data with an external personal computer, i.e. host computer, which is not shown; connected to the input terminal thereof are the photosensors 13 of the dispensing and counting devices 8, the holder position detecting sensor 41 of the holder unit 31, the bar code reader 42, and the key switch 43. Connected to the output terminal of the microprocessor 45 are the dispensing drums 9 of the dispensing and counting devices 8, the turntable motor 18, the holder motor 39, the shutter opening/closing means 24, and the display 47. The operation of the medication filling apparatus 1 in accordance with the present invention will now be described. FIG. 13 shows the flowchart of the program for the medication dispensing operation performed by the microprocessor 45; FIG. 14 gives the flowchart of the program for the medication filling operation performed by the microprocessor 45. While the power is ON, the shutter 23 closes the dispensing port 22 of the guide 21 and all count values stay reset. The turntable motor 18 is energized at all times so that the turntable 16 turns at all times. It is also possible to halt the turntable 16 temporarily when the preparing operation is halted for a predetermined time.

When an operator keys in medication dispensing data into the personal computer, the personal computer requests the transmission of data from the medication filling apparatus 1. As soon as the microprocessor 45 of the medication filling apparatus 1 receives the request for the data transmission from the personal computer through the transmitting and receiving means 46 in step S1, it determines in step S2 whether all the holders 33 of the holder unit 31 retain and are full of medications; if it decides that they are full, then it goes back to step S1 where it stands by.

If the microprocessor decides in step S2 that the holders 33 are not filled up, then it responds, in step S3, to the personal computer, reporting that it is ready to receive data and it then receives and reads the dispense data sent from the personal computer. In step S4, based on the dispense data, the microprocessor 45 drives and rotates the dispensing drum 9 of the dispensing and counting device 8 of the tablet case 7 for holding the type of medication specified in the dispense data.

As the dispensing drum 9 rotates, the medications drop one by one as previously mentioned and the dropped medications are received by the turntable 16. The number of dropping medication is counted by the microprocessor 45 through the photosensor 13. In step S5, the microprocessor determines whether the counting has been completed; if the determination result is negative, then it goes back to step S4 to repeat the same process. When the number of dropped medications detected by the photosensor 13 coincides with the number of the medications based on the dispense data, the microprocessor 45 decides that the counting has been completed and it advances from step S5 to step S6.

The medication which has dropped onto the turntable 16 moves toward the guide 21 located on the circumference of the turntable 16 due to the centrifugal force of the turntable 16. At this time, since the projecting cone 16A is located at the center of the turntable 16 at which the centrifugal force is weaker, the medication dropped onto the center moves outward along the slope of the projecting cone 16A and then moves toward the guide 21 owing to the centrifugal force. The partitioning vanes 17, 17 provided on the turntable 16 turn with the turntable, so that the medication which stays stationary on the turntable 16 may be also pushed and moved outside smoothly. Thus the medications dropped onto the turntable 16 are collected and moved to the guide 21 and aligned, being pushed against the guide 21.

In step S6, the microprocessor 45 selects an empty holder 33, drives the holder motor 39 to rotate the holder unit 31, and positions the empty holder 33 under the dispensing port 22 of the guide 21 with the aid of the holder position detecting sensor 41. Then in step S7, the microprocessor 45 swings the shutter 23 outward as shown in FIG. 6 by the shutter opening/closing means 24 to release the dispensing port 22 for a predetermined time, e.g. 1 second, and then close it.

When the dispensing port 22 is released, the medications aligned against the inner circumferential wall of the guide 21 are collected at the dispensing port 22 one after another by the centrifugal force and moved into the holder 33 through the inlet 33A of the holder 33 (step S8).

The microprocessor 45 repeats the procedure from step S4 to step S8 for all types of medications specified by the prescription data to fill the separate holders 33 for the different medications.

The operator attaches a bar code label L, which carries the bar code indicating one type of the medications specified by the dispense data, to the side face of a vial V serving as the predetermined container. When the container is inserted into the filling section 3B through the inserting opening 6 of the medication filling apparatus 1, the bar code on the bar code label L is read through the bar code reader 42. The microprocessor 45 determines in step S9 of FIG. 14 whether the bar code indicating the type of medication has been successfully read through the bar code reader 42; if it decides that the bar code has been read properly, then it proceeds to step S10 wherein it decides whether the holder 33 has been filled with the particular type of medication. If the microprocessor finds that the holder has not yet been filled, then the microprocessor returns to step S9 wherein it stands by.

When the specified type of medications are charged in the holder 33 in step S8, the microprocessor 45 advances from step S10 to step S11 wherein it selects the holder 33 filled with the medications, drives the holder motor 39 to rotate the holder unit 31, and positions the holder 33 at the inserting opening 6 with the aid of the holder position detecting sensor 41.

Under the condition stated above, the port of vial V is positioned under the outlet 33B of the holder 33 and the cover 36 is opened by the handle 37 to fill vial V with the specified type of medications from the holder 33 (step S12).

Thus according to the present invention, the medications dispensed from the tablet case 7 can be received by the turntable 16 which rotates under the tablet case 7, moved to the circumferential wall of the guide 21 by the centrifugal force generated by the rotation, and gathered at the dispensing port 22 formed in the guide 21 before they are finally dispensed. Hence, the medication, which has been specified among a plurality of types, can be brought to the single dispensing port 22 to fill vial V through the holder 33. This enables significantly improved workability and quick filling, making it possible to shorten the waiting time and therefore provide waiting patients with better service.

Especially because the centrifugal force of the turntable 16 is utilized rather than depending solely on the gravitational force as in the conventional apparatus to collect the medications dispensed from a plurality of tablet cases 7, the vertical dimension of the medication filling apparatus 1 can be reduced, thus enabling the apparatus to contribute to effective use of the spaces at facilities such as hospitals.

In addition, when a plurality of medications are charged in succession, even if bar code label L on vial V, which has been prepared by an operator, mismatches the type of the medication dispensed from the tablet case 7, the medications dispensed earlier can be retained in the holder 33 until vial V, which has been supplied earlier, is filled with medications. When the proper vial V with the right bar code label L for the retained medications is supplied, the cover 36 of the holder 33 is opened to charge the medication into the vial. Hence, especially when charging a plurality of types of medications into vials V, the filling workability will be improved, leading to further reduced total operation time.

Figure 15:
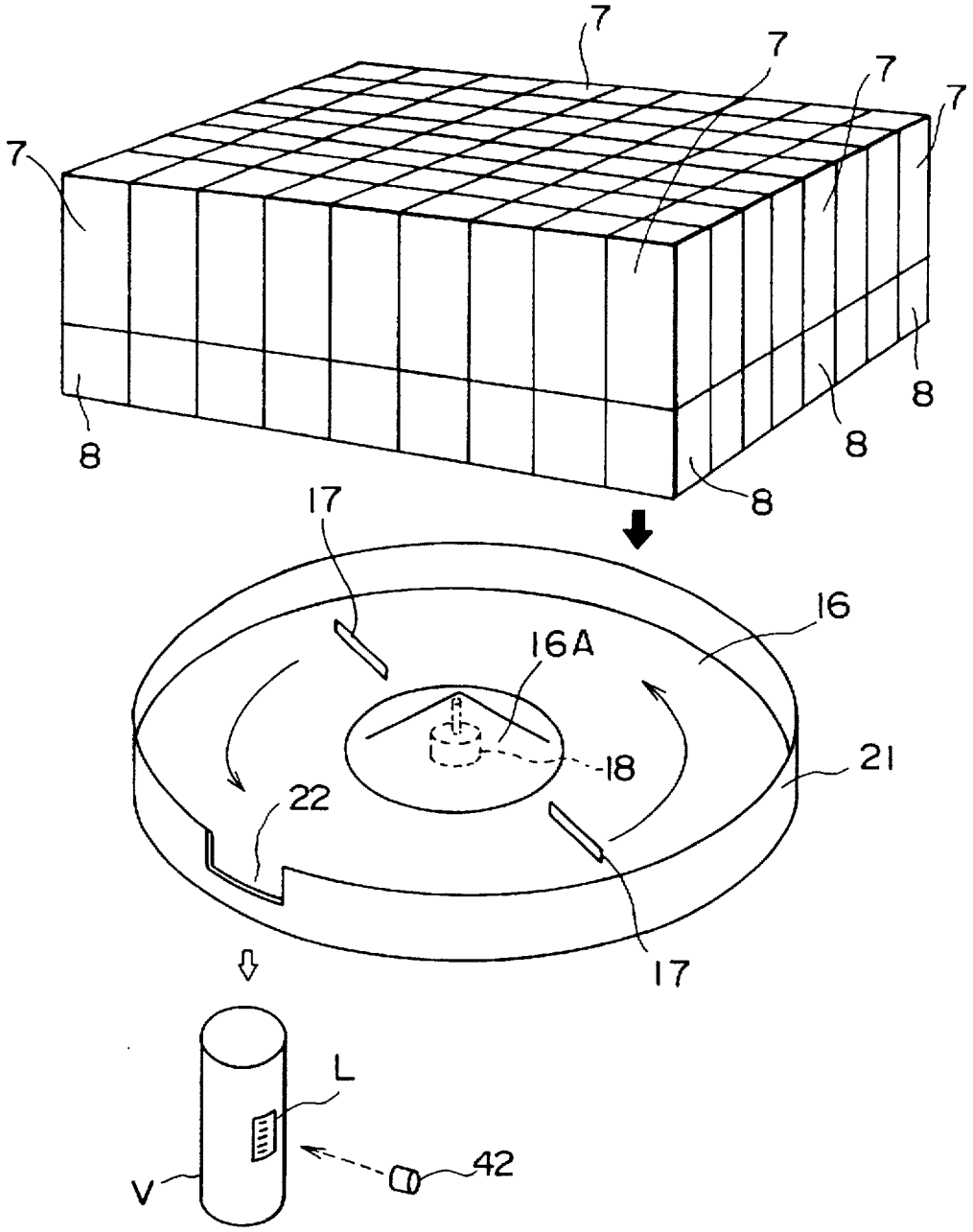
FIG. 15 is an illustration of the internal configuration of another medication filling apparatus in accordance with the present invention.

FIG. 15 shows the internal configuration of the medication filling apparatus 1 according to another aspect of the present invention. In the drawing, the same reference numerals indicate the same components or the same functions. In this embodiment, the dispensing port 22 of the guide wall 21 is not provided with the shutter 23. The holder unit 31 beneath the guide is also omitted; the dispensing port 22 is disposed directly above the inserting opening 6. Further, the medication filling apparatus 1 is not connected to the personal computer as in the first embodiment; instead, it is used as a discrete apparatus, i.e. a standalone apparatus.

Figure 16:
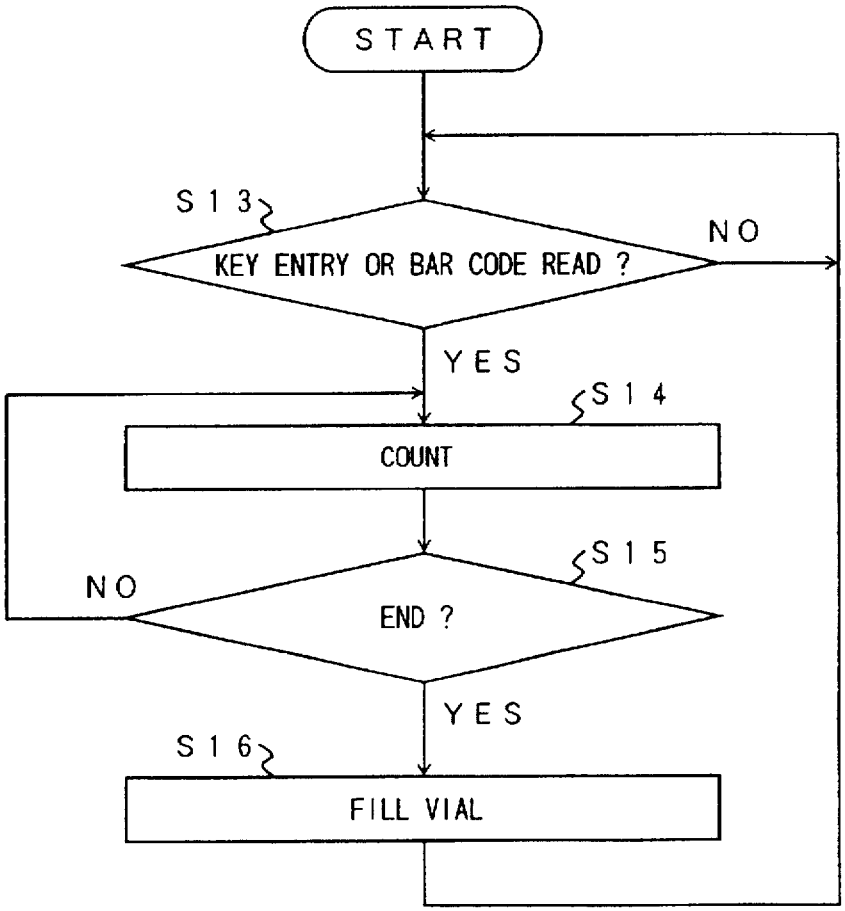
FIG. 16 is a flowchart illustrating a program for the microprocessor of FIG. 15.

The operation of this embodiment will now be described in conjunction with the flowchart for the program of the microprocessor 45 shown in FIG. 16. It is assumed that, with the power ON, the count values and the like are reset and the turntable motor 18 is energized at all times so that the turntable 16 rotates at all times.

When an operator enters the data of a dispensation, through, for example, the key switch 43, the microprocessor 45 reads the data in step S13 and drives the dispensing drum 9 of the dispensing and counting device 8 for the tablet case 7, which contains the type of medications specified in the prescription data, according to the aforesaid prescription data in step S14. In this embodiment, it is also assumed that the operator sets vial V into the filling section 3B through the inserting opening 6 when entering the data through the key switch 43.

As the dispensing drum 9 revolves, the medications drop one at a time and they are received by the turntable 16 as mentioned in the previous embodiment. The number of the dropped medications is counted by the microprocessor 45 through the photosensor 13. In step S15, the microprocessor determines whether the count has been completed; if it decides that it has not yet been completed, then it goes back to step S14 to repeat the same procedure. When the number of dropped medications detected by the photosensor 13 coincides with the number of the medications based on the dispense data, the microprocessor 45 decides that the counting has been completed and it proceeds from step S15 to step S16.

The medications which have dropped onto the turntable 16 move toward the guide 21 located on the circumference of the turntable 16 due to the centrifugal force of the turntable 16. At this time, since the projecting cone 16A is located at the center of the turntable 16 at which the centrifugal force is weaker, the medication dropped to the center moves outward along the slope of the projecting cone 16A and then moves toward the guide 21 owing to the centrifugal force. The partitioning vanes 17, 17 provided on the turntable 16 turn with the turntable, so that the medication which stays stationary on the turntable 16 may be also pushed and removed outside smoothly. Thus the medications dropped onto the turntable 16 are collected and moved to the guide 21 and aligned, being pushed against the guide 21.

The medications aligned against the inner wall of the guide 21 are gathered at the dispensing port 22 one after another by the centrifugal force and moved into vial V inserted and positioned below (step S16).

In the above description, the dispense data is entered through the key switch 43; however, the method is not limited thereto and a bar code may be used as in the case of the first embodiment. If bar codes are used, then the operator attaches the bar code label L, on which is printed the bar code indicating the type of medication specified in the dispense data, to the side face of vial V and sets vial V to the filling section 3B through the inserting opening 6 as previously mentioned. The microprocessor 45 reads the bar code on bar code label L through the bar code reader 42 in step S13 of FIG. 16 and fills vial V with a predetermined quantity of medications specified in the bar code in the same manner as that stated above.

With the arrangement described above, although it may take slightly longer to complete the filling, the internal mechanisms of the medication retaining means, so that they can be charged into a right container after the container supplied earlier has been filled. This feature helps further improve the filling workability and further shorten the total operation time especially when a plurality of different medications are charged.

According to a further aspect of the present invention, the medications are dispensed from the tablet cases, which hold the medications separately by type, and counted by the dispensing and counting device, and the medications dispensed from the tablet cases are received by the turntable rotating under the tablet cases and gathered onto the surrounding guide by the centrifugal force produced by the rotating turntable. The medications are then collected and brought to the dispensing port formed in the guide before they are dispensed; therefore, the medications can be charged into containers by disposing predetermined containers at the dispensing port. Thus, medications specified among a plurality of different medications can be charged in containers through the same single dispensing port. This feature also leads to markedly improved workability and quick filling and enables shortened waiting time, thereby helping to provide the waiting patients with better service.

In particular, whereas the conventional art depends solely on the gravitational force to collect medications which have been dispensed from a plurality of tablet cases, the present invention makes use of the centrifugal force of the turntable. This makes it possible to reduce the size of the medication filling apparatus especially in the vertical dimension, contributing to effective use of the space at facilities including hospitals and pharmacies.

According to a still further aspect of the present invention, the shutter for opening and closing the dispensing port of the filling apparatus 1 can be simplified and therefore the size and cost of the whole apparatus can be reduced, making it ideally suited for small hospitals and the like.

In the embodiments stated above, vial V is used to charge medications. The containers, however, are not limited to vials; resinous bags or the like may be used as the containers for charging medications.

Thus, according to the aspect of the present invention, medications are dispensed from the medication containing means, which hold medications separately by type, and counted by the dispensing and counting means, and the medications dispensed from the medication containing means are collected and moved to the dispensing port by the medication filling means so that the medications can be charged through the dispensing port into predetermined containers. Since the medications specified among a plurality of different medications can be charged into different containers through the same port, dramatically improved workability can be achieved with resultant quicker filling. This shortens patients waiting time, leading to better service for patients.

Further, according to another aspect of the present invention, the medication filling means is comprised of the medication collecting means which receives and collects the medications dispensed from the medication containing means and the means for temporarily retaining the medications which have been gathered by the medication collecting means. Therefore, when a plurality of different medications are charged in succession, for example, even if the order of the containers arranged by an operator mismatches the order of the types of medications dispensed from the medication containing means, the type of medications which have been dispensed earlier can be retained temporarily in the guide, the plurality of holders which are selectively disposed for the dispensing port and which temporarily retain the medications, which have been ejected through the dispensing port, and the covers for opening and closing the outlets of the respective holders have been added, so that when, for example, a plurality of different medications are packed in succession, even if the order of the containers arranged by an operator mismatches the order of the types of medications dispensed from the medication containing means, the type of medications which have been dispensed earlier can be gathered and retained in a predetermined holder by opening/closing the dispensing port by the shutter to wait until a container prepared earlier has been filled with a medication, then the cover of the holder is opened when the container for the retained medications is ready so that the container may be filled with the medication. Thus, the filling workability will be further improved and the total operation time will be further reduced especially when charging a plurality of different medications.

What is claimed is:

1. A medication filling apparatus comprising:

a plurality of medication containing means each for containing a medication separately by type;

dispensing and counting means for dispensing the medications from a selected one or more of said plurality of medication containing means and counting them; and medication filling means comprising a rotatable turntable located under said plurality of medication containing means for collecting and moving the medications which have been dispensed from said selected one or more medication containing means, said turntable having a dispensing port for charging the one or more medications collected on said turntable into a predetermined container.

2. A medication filling apparatus according to claim 1 further comprising:

a dispensing port on said turntable through which the collected medications are discharged from said turntable.

3. A medication filling apparatus comprising:

a plurality of medication containing means each for containing a medication separately by type;

dispensing and counting means for dispensing the medications from a selected one or more of said plurality of medication containing means and counting them during a dispensing cycle; and medication filling means for charging the medications which have been dispensed from said selected one or more medication containing means into a predetermined container; wherein said medication filling means comprises:

medication collecting means which receives and collects the medications dispensed from said selected one or more medication containing means; and a plurality of means each for temporarily retaining the medications collected by said medication collecting means during a dispensing cycle and for charging into a predetermined container.

4. A medication filling apparatus according to claim 3 wherein the medication collecting means comprises:

a turntable located under said plurality of medication containing means which rotates to receive the medications which have been dispensed from said selected one or more medication containing means.

5. A medication filling apparatus according to claim 4 further comprising:

a dispensing port on said turntable through which the collected medications are discharged from said turntable to each said temporary retaining means.

6. A medication filling apparatus as in claim 3 wherein said means for temporarily retaining comprises a plurality of holders; and means for moving said holders relative to said collecting means so that each holder respectively receives the medication collected by said collecting means during a dispensing cycle.

7. A medication filling apparatus according to claim 6 wherein the medication collecting means comprises:

a turntable located under said plurality of medication containing means which rotates to receive the medications which have been dispensed from said selected one or more medication containing means.

8. A medication filling apparatus according to claim 7 further comprising:

a dispensing port on said turntable through which the collected medications are discharged from said turntable into said holder during each dispensing cycle.

9. A medication filing apparatus as in claim 8 wherein each said holder comprises a tube having an inlet and an outlet, the medication collected during a dispensing cycle being discharged from said collecting means into a tube inlet.

10. A medication filling apparatus comprising:

a plurality of tablet cases each for holding a medication separately by type;

a dispensing and counting device for dispensing the medications from a selected one or more of said tablet cases according to predetermined dispensing data and for counting them;

a turntable located under said tablet cases and which rotates to receive the medications dispensed from said selected one or more tablet cases;

a guide provided around said turntable; and a dispensing port formed in said guide.

11. A medication filling apparatus comprising:

a plurality of tablet cases each for holding a medication separately by type;

a dispensing and counting device for dispensing the medications from a selected one or more of said tablet cases according to predetermined dispensing data and for counting them;

a turntable located under said tablet cases which rotates to receive the medications which have been dispensed from said selected one or more tablet cases;

a guide provided around said turntable;

a dispensing port formed in said guide;

a shutter for opening and closing the dispensing port;

a plurality of holders each having an inlet and an outlet which are selectively disposed relative to said guide dispensing port and which receive through the inlet the medications which have been dispensed through the dispensing port to temporarily retain the received medications; and a cover for opening and closing the outlet of each holder.

* * * * *